US005308188A

United States Patent [19]

Shaftner

[11] Patent Number: 5,308,188

[45] Date of Patent: May 3, 1994

[54] RAMP FOR TEMPORARILY ELEVATED UTILITY ACCESS HOLE

[76] Inventor: Timothy K. Shaftner, 305 Silversmith La., Charlotte, N.C. 28270

[21] Appl. No.: 709,898

[22] Filed: Jun. 4, 1991

[51] Int. Cl.[5] ..... E02D 29/14

[52] U.S. Cl. ..... 404/25; 404/32; 404/35

[58] Field of Search ..... 404/25, 26, 32, 35, 404/42, 71; 273/34 R, 34 B, 176 B, 178 R, 178 B; 14/74

[56] References Cited

U.S. PATENT DOCUMENTS

| | | | |
|---|---|---|---|
| 3,752,482 | 8/1973 | Cassel | 273/176 B |
| 4,808,025 | 2/1989 | McGinnis | 404/26 |
| 4,842,443 | 6/1989 | Argandora | 404/25 |
| 4,917,531 | 4/1990 | McGinnis | 404/26 |
| 4,925,191 | 5/1990 | Ogilvie | 273/178 A |

FOREIGN PATENT DOCUMENTS

| | | | |
|---|---|---|---|
| 83997 | of 1921 | Australia | 404/25 |
| 27088 | of 1910 | United Kingdom | 404/25 |

*Primary Examiner*—William P. Neuder

*Attorney, Agent, or Firm*—Shefte, Pinckney & Sawyer

[57] ABSTRACT

A protective ramp for placement around a temporarily elevated underground utility access hole support. The ramp includes a ramp member having a top surface and an obverse bottom surface, and an opening, usually centrally disposed, of a size to be placed in closely surrounding position around a predetermined size access hole support. The ramp member also has a thickness defining the opening approximating the height of the elevated access hole support over which the ramp is to be placed and a progressively diminishing thickness from the opening to the outer edge wherein the ratio of the thickness of the ramp member at the opening to the distance from the opening to the outer edge is no less than one to five.

13 Claims, 2 Drawing Sheets

RAMP FOR TEMPORARILY ELEVATED UTILITY ACCESS HOLE

TECHNICAL FIELD AND BACKGROUND OF THE INVENTION

This invention relates to a ramp for placement around a temporarily elevated utility access hole. Manhole covers, gas and water utility covers, storm sewer inlets and similar utility covers are raised before streets are repaved, so that after repaving the covers will be substantially flush with the new pavement surface. The covers are generally raised a minimum of two inches and sometimes substantially more. In other instances the covers are "raised" by lowering the surface of the surrounding pavement by grinding the surface away in preparation for repaving. Often, the covers are raised days or weeks before the actual repaving occurs.

In some instances barricades are placed around the raised covers. The barricades themselves can become traffic hazards since they can be blown or knocked over. In some instances barricades are not used, and the raised covers can present a serious traffic hazard. Traffic collisions can occur when vehicles move out of a lane of traffic or suddenly reduce speed to avoid hitting one of the raised covers. Vehicle suspensions can also be damaged by driving over the raised covers at too high a speed.

SUMMARY OF THE INVENTION

Therefore, it is an object of the invention to provide a ramp for placement around a temporarily elevated underground utility access hole support, such as a manhole cover, gas or water utility cover, storm sewer inlet or similar utility cover.

It is another object of the invention to provide a ramp which has a smooth, gradual decrease in thickness from the center to the edge.

It is another object of the invention to provide a ramp which does not need fastening means to keep it in place around the access hole support.

It is another object of the invention to provide a ramp which is durable and easy to fabricate, install and remove for reuse.

It is another object of the invention to provide a ramp which can include traction increasing means, either as additives to the ramp or as an inherent property of the material from which the ramp is fabricated.

It is another object of the invention to provide a ramp which can be molded in different thicknesses and used singly or stacked on top of one another.

These and other objects of the present invention are achieved in the preferred embodiments disclosed below by providing a protective ramp for placement around a temporarily elevated underground utility access hole support. The ramp includes a flat ramp member having a top surface and an obverse bottom surface, and an therein of a size to be placed in closely surrounding position around a predetermined size access hole support. The ramp member also has a thickness defining the opening approximating the height of the elevated access hole support over which the ramp is to be placed and a progressively diminishing thickness from the opening to the outer edge thereof wherein the ratio of the thickness of the ramp member at the opening to the distance from the opening to the outer edge thereof is no less than one to five.

According to one preferred embodiment of the invention, the ramp is constructed of an elastomeric material.

According to another preferred embodiment of the invention, the shape of the ramp at its outer edge is substantially circular.

According to yet another preferred embodiment of the invention, the ramp is approximately two inches thick at the opening and approximately one-half inch thick at its outer edge.

According to another embodiment of the invention, the shape of the ramp at its outer edge is substantially square.

According to yet another preferred embodiment of the invention, the ramp includes gripping means on the top surface thereof.

According to alternative embodiments of the invention, the gripping means comprise molded-in adjacent areas of different heights, grit material embedded into the top surface of the ramp member, or the ramp is constructed of a binary self thickening room temperature vulcanizing liquid rubber having inherent non-slip surface properties when cured.

According to one preferred embodiment of the invention, the ramp member is sized to be placed around a conventional street manhole, and has a central opening approximately 25⅜ inches in diameter.

According to another preferred embodiment of the invention, the ramp member is substantially circular and has an outer diameter of approximately 48 inches.

According to yet another preferred embodiment of the invention, the ramp member is sized to be placed around a conventional street gas utility hole, and has a central opening approximately 8 inches in diameter.

According to one preferred embodiment of the invention, the ramp member is substantially circular and has an outer diameter of approximately 24 inches.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
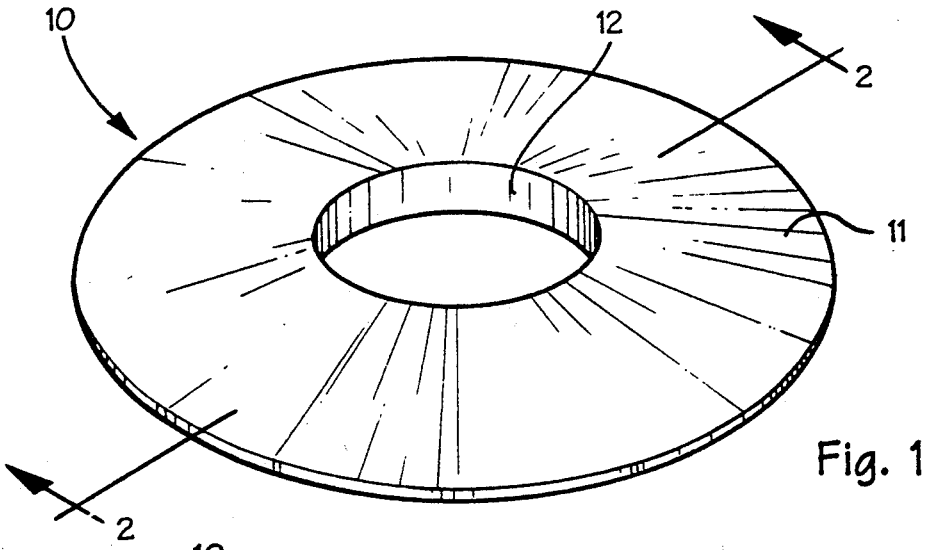
FIG. 1 is a perspective view of an embodiment of the ramp.

Referring now specifically to the drawings, a ramp according to the present invention is illustrated in FIG. 1 and shown generally at reference numeral 10. Ramp 10 is formed of a ramp member 11 defining a hole 12 formed in the center and sized to fit closely around a utility cover and support of a predetermined matching size. For example, a conventional manhole cover an support is 25⅜ inches in diameter. A ramp 10 to fit over such a manhole cover would be constructed to have a center opening of approximately 25½ inches. In order to provide a gradual taper, the distance from the edge of the opening to the outer edge of the ramp member 11 is approximately 12 inches. This provides a ratio of one to 6 between the thickness of the ramp member at the opening to the distance from the opening to the outer edge. The overall diameter of ramp 11 according to this embodiment is 48 inches.

The relationship also provides enough size and weight so that the ramp 10 can be placed over the manhole cover and left in place without holding or fastening devices as shown in U.S. Pat. Nos. 4,808,025 and 4,917,531 to McGinnis.

Figure 2:
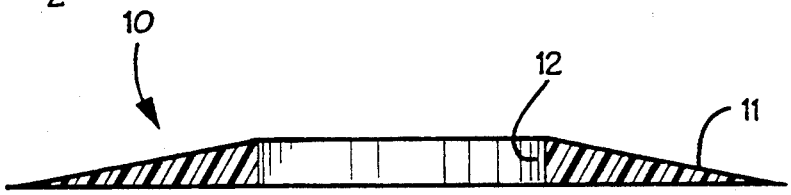
FIG. 2 is a vertical cross-section of the ramp shown in FIG. 1.
Figure 3:
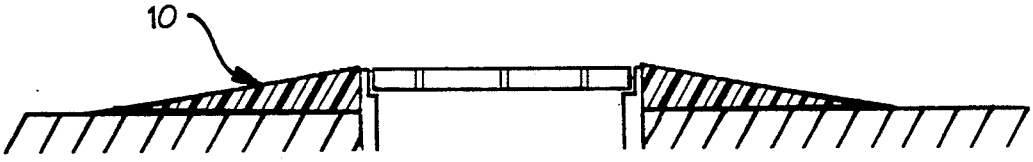
FIG. 3 is a vertical cross-section of the ramp shown in FIGS. 1 and 2 in place over a manhole cover and support.

Ramp member 11 of a size to fit over a conventional manhole cover is preferably approximately two inches in thickness at the opening and a thickness of approximately one-half inch at the outer edge. This relationship is shown in FIG. 2. The ramp 10 is shown in place over a manhole cover and support 15 in FIG. 3.

Figure 4:
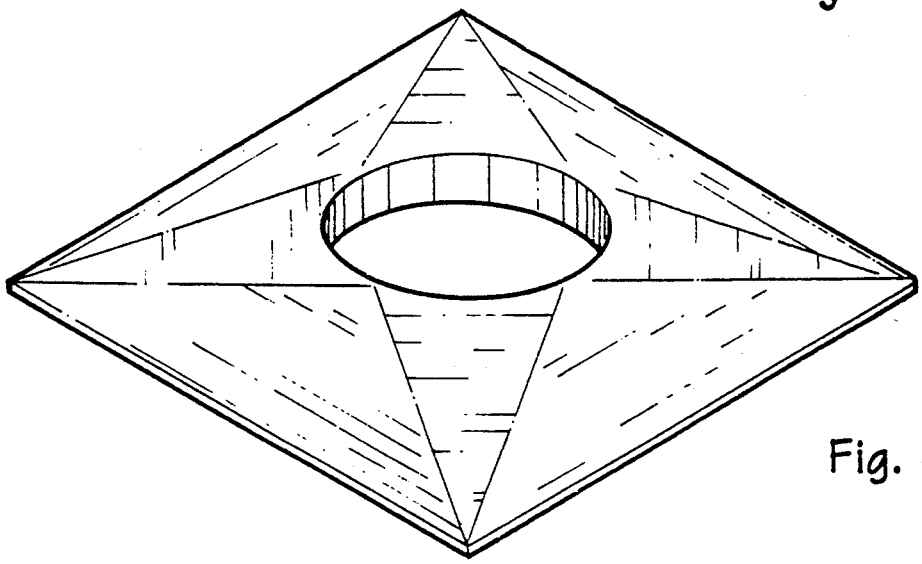
FIG. 4 is a perspective view of an alternative embodiment of the ramp having a substantially square shape.

A variation in ramp shape is shown in FIG. 4, and comprises a ramp 20 formed of a square ramp member 21 which is 49½ inches on a side and having a central opening 22 for receiving the utility cover and support as illustrated and described above. Opening 22 is 25½ inches in diameter. The distance from the inner edge of the ramp 21 to a corner of ramp member 21 is 35¼ inches, and to the outer edge equidistant two corners is approximately 70½ inches. The ramp member can be molded into any desired shape, and can include an eccentrically positioned opening when necessary, so that the ramp member can be fitted onto a manhole cover or storm sewer inlet close to a curb. If necessary, ramp member can be cut into different shapes to fit a given configuration. For example, one side of the ramp member 11 can be cut off to define a tangent if necessary to fit against a curb or other obstacle.

A ramp member two inches thick at the inner edge is usually sufficient to provide a safe transition between the road surface and the raised cover and support. However, when necessary, additional ramp members can be placed one on top of the other over the same cover to provide greater thickness. The ramp member can also be made in different thicknesses to accommodate differing height requirements singly or in multiples. For example, a ramp member could be molded three inches thick at the inner edge to fit singly over a cover raised approximately three inches above the surrounding road surface. Alternatively, ramp members could be molded in one inch and two inch thicknesses, so that one of each doubled would provide the same three inch high ramp.

Whatever the size or shape, the ramp member is molded from an elastomeric material. The material may be a natural or synthetic rubber material similar to automobile tire rubber. However, the material found to be preferable is a binary self thickening room temperature vulcanizing liquid rubber having inherent non-slip surface properties when cured. Such a material is manufactured by Polytek Development Corp. of Lebanon, N.J. under the trademark "POLYGEL." The material is formed by mixing to liquids in a one-to-one ratio. The liquids immediately gel into a trowellable consistency which can be poured or trowelled into a mold. The material cures overnight at room temperature into a tough, flexible rubber with high tear strength, good grease and oil resistance, good dimensional stability and excellent inherent non-slip characteristics. Polytek product numbers 74–65 and 74–55 have been found to be suitable. Complete details regarding these products can be found in Technical bulletin 110890 of the manufacturer.

Figure 5:
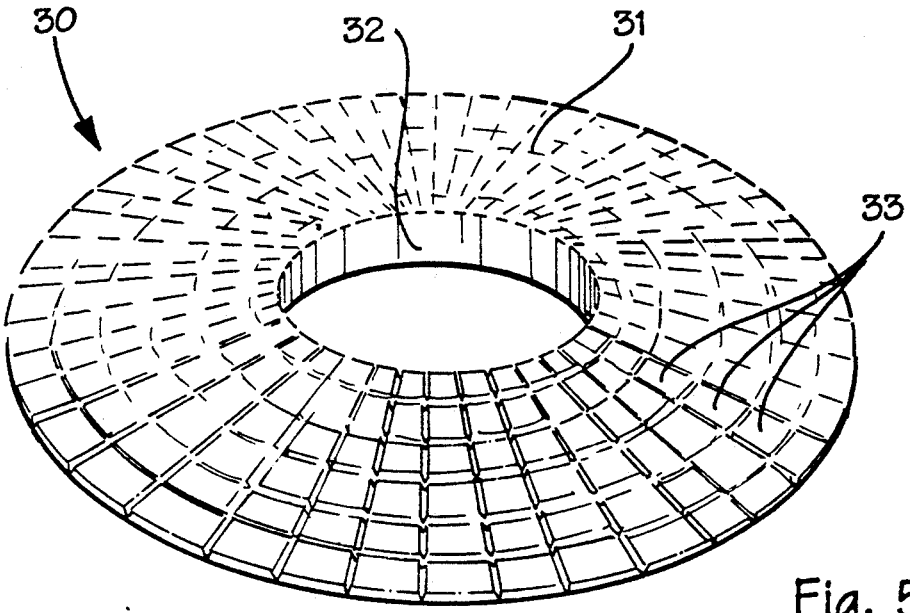
FIG. 5 is a perspective view of an alternative embodiment of the ramp having a gripping treads molded into the top surface.

As is shown in FIG. 5 treads 33 or other forms of irregularities can be molded into the top surface to increase traction, as is illustrated in FIG. 5 with reference to ramp 30 formed of ramp member 31 defining opening 32. The treads 33 can be of any desired shape of pattern.

Figure 6:
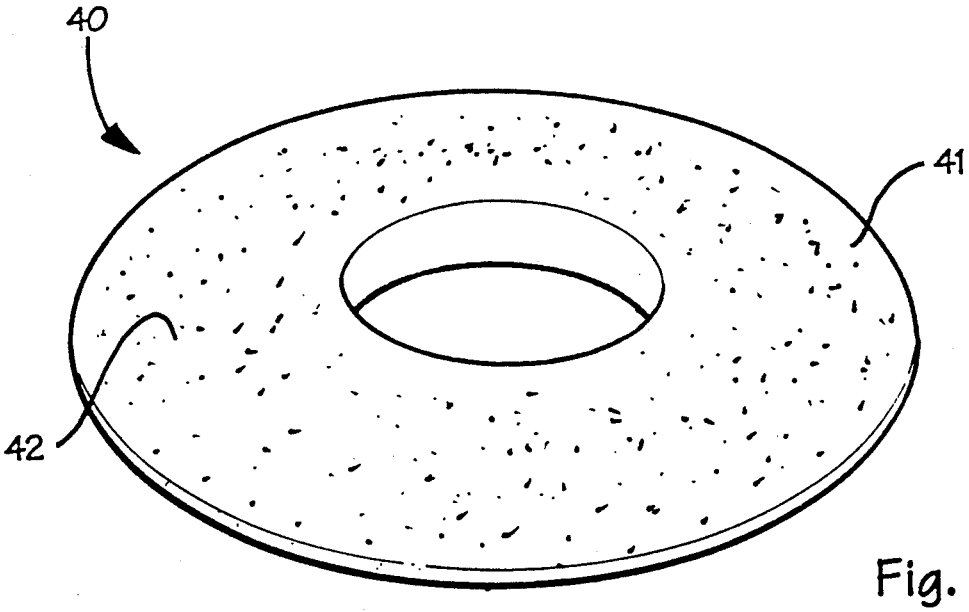
FIG. 6 is a perspective view of an alternative embodiment of the ramp having grit on the top surface as a traction-enhancing material.

Ramp 40, as is shown in FIG. 6, has grit, small pebbles or other surface roughening materials 42 molded into the ramp member 41. One method includes the steps of sprinkling the roughening material, such as sand or other grit, onto the mold surface before pouring the ramp member 41. The molding liquid molds around the grit 42 so that when the ramp member 41 is removed from the mold, the grit 42 is exposed to the surface of, but embedded in the ramp member 41.

A ramp is described above. Various details of the invention may be changed without departing from its scope. Furthermore, the foregoing description of the preferred embodiment of the invention and the best mode for practicing the invention are provided for the purpose of illustration only and not for the purpose of limitation, the invention being defined by the claims.

We claim:

1. In combination, a manhole cover support temporarily elevated above an adjacent roadway and a protective ramp placed removably around said manhole cover support to prevent potentially damaging impact with said manhole cover support by vehicles traveling on the roadway, said protection ramp comprising:

(a) a ramp member having a top surface and an obverse bottom surface, said bottom surface being supported on the roadway;

(b) said ramp member having an opening therein of a size which receives and closely surrounds said manhole cover support;

(c) said ramp member having a thickness defining said opening approximating the elevated height of said manhole cover support around which the ramp is placed, said top surface of said ramp member at said opening being approximately flush with said manhole cover support;

(d) said ramp member having a progressively diminishing thickness from the opening to the outer edge thereof, said top surface of said ramp member at said outer edge being approximately flush with the roadway;

(e) wherein the ratio of the thickness of the ramp member at the opening to the distance from the opening to the outer edge thereof is no less than one to five.

2. A ramp according to claim 1, wherein said ramp is constructed of an elastomeric material.

3. A ramp according to claim 1, wherein the shape of said ramp at its outer edge is substantially circular and the opening is centrally disposed.

4. A ramp according to claim 1, wherein said ramp is approximately two inches thick at the opening and approximately one-half inch thick at its outer edge.

5. A ramp according to claim 1, wherein the shape of said ramp at its outer edge is substantially square.

6. A ramp according to claim 1, wherein said ramp includes gripping means on the top surface thereof.

7. A ramp according to claim 6, wherein said gripping means comprise molded-in adjacent areas of different heights.

8. A ramp according to claim 6, wherein said gripping means comprise grit material embedded into the top surface of the ramp member.

9. A ramp according to claim 1, wherein said ramp member is sized to be placed around a conventional street manhole, and has a central opening approximately 25½ inches in diameter.

10. A ramp according to claim 9, wherein said ramp member is substantially circular and has an outer diameter of approximately 48 inches.

11. A ramp according to claim 1, wherein said ramp member is sized to be placed around a conventional street gas utility hole, and has a central opening approximately 8 inches in diameter.

12. A ramp according to claim 11, wherein said ramp member is substantially circular and has an outer diameter of approximately 24 inches.

13. A ramp according to claim 2, wherein said ramp is constructed of a binary self thickening room temperature vulcanizing liquid rubber having inherent non-slip surface properties when cured.

* * * * *